US005872326A

United States Patent [19]

Manhart

[11] Patent Number: 5,872,326

[45] Date of Patent: Feb. 16, 1999

[54] APPARATUS FOR TRIGGERING AN AVALANCHE OR THE LIKE

[75] Inventor: Michael Manhart, Lech am Arlberg, Austria

[73] Assignee: Konrad Doppelmayr & Sohn Maschinenfabrik Gesellschaft mbH & Co. KG, Wolfurt, Austria

[21] Appl. No.: 837,240

[22] Filed: Apr. 10, 1997

[30] Foreign Application Priority Data

Apr. 10, 1996 [AT] Austria ..... 641/96

[51] Int. Cl.[6] ..... F42B 5/02

[52] U.S. Cl. ..... 102/439; 102/258; 102/346; 102/372; 102/473; 102/487; 102/499; 42/105; 89/1.811; 89/1.812; 89/1.814

[58] Field of Search ..... 102/205, 258, 102/346, 372, 430, 439, 472, 473, 482, 487, 499; 42/105; 89/1.55, 1.811, 1.812, 1.814

[56] References Cited

U.S. PATENT DOCUMENTS

| | | | |
|---|---|---|---|
| 1,309,743 | 7/1919 | Nichols | 102/372 |
| 1,367,464 | 2/1921 | Cook | 102/430 |
| 1,560,628 | 11/1925 | Wiley | 102/487 |
| 2,023,158 | 12/1935 | Williams | 102/482 |
| 2,459,854 | 1/1949 | Swift, Jr. | 102/472 |
| 4,353,301 | 10/1982 | Jacobsen | 102/482 |

FOREIGN PATENT DOCUMENTS

| | | | |
|---|---|---|---|
| 145696 | 6/1985 | European Pat. Off. | 42/105 |
| 2398282 | 3/1979 | France | 102/439 |
| 10494 | 12/1910 | United Kingdom | 102/483 |
| 729372 | 5/1955 | United Kingdom | 102/472 |

*Primary Examiner*—Harold J. Tudor
*Attorney, Agent, or Firm*—Herbert L. Lerner; Laurence A. Greenberg; Werner H. Stemer

[57] ABSTRACT

Avalanches, such as snow avalanches, are triggered with an explosive charge. The charge is propelled into a potential avalanche slope and detonated therein. The explosive charge is first located in a tube which is closed at one end and which also houses a propelling charge with which the explosive charge is propelled from the tube into the avalanche slope.

15 Claims, 6 Drawing Sheets

FIG. 2
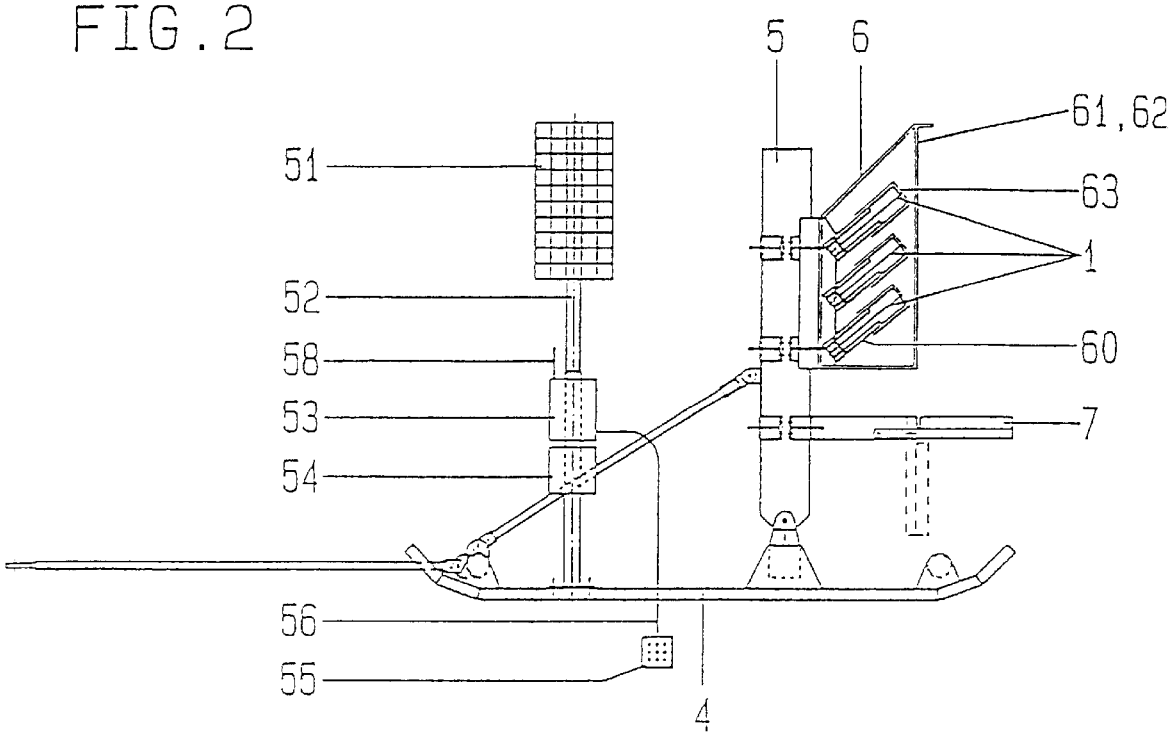
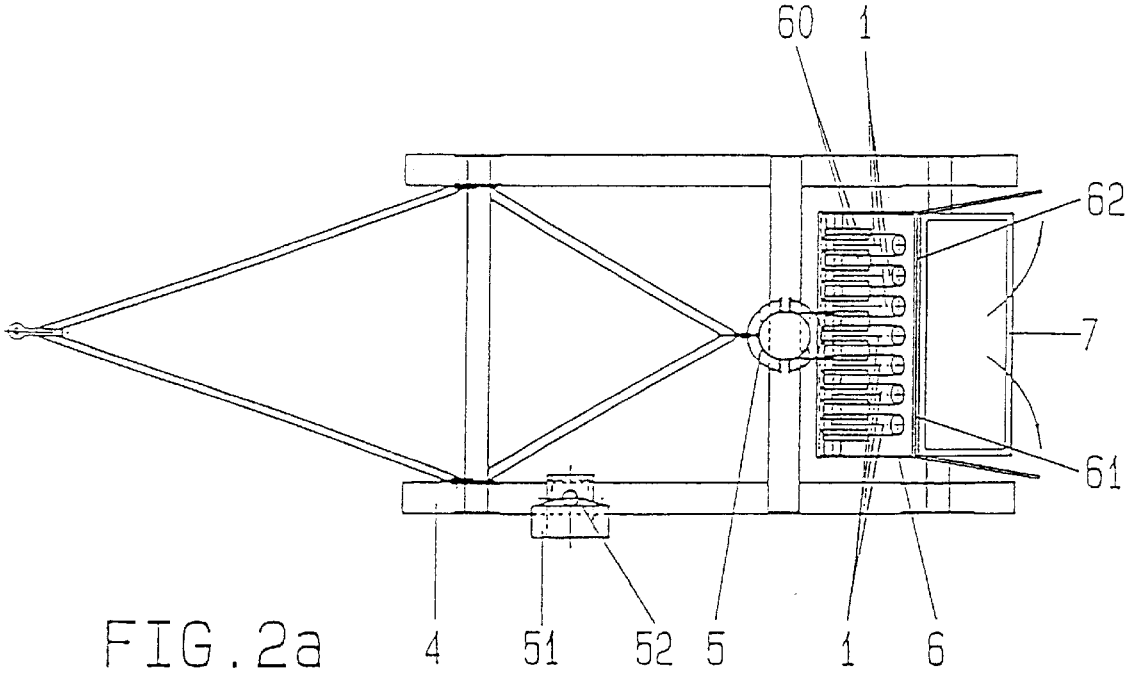
FIG. 2a

APPARATUS FOR TRIGGERING AN AVALANCHE OR THE LIKE

BACKGROUND OF THE INVENTION

Field of the Invention

The invention pertains to an apparatus for triggering an avalanche by means of an explosive charge, which is conveyed to an avalanche slope and which is detonated therein.

There exists a need to artificially trigger avalanches for safety reasons in upper mountainous regions, especially those that have been developed for skiing. Skiers are naturally exposed to the uncontrolled triggering of avalanches. A similar need to trigger avalanches in a controlled manner also exists where a possible destruction of housing areas, roads, forests or the like is to be prevented, which can be caused by uncontrolled starts of avalanches.

It has become known, heretofore, to artificially trigger avalanches by firing rockets at avalanche slopes. This method, however, has the disadvantage that the target area is reached only with inferior accuracy and that, furthermore, populated areas may be hit. Also, the trigger success (the ratio between the number of attempts and actual triggering of a successful avalanche) is less than satisfactory with such a process. Furthermore, rocket missiles are expensive and, due to the fact that they are characterized as military weapons, the use thereof is, or should be, subjected to legal and contractual limitations.

It has also been known, heretofore, to transport the explosive charges to the target area by means of a cableway system specifically established for the purpose and to detonate the same after delivery. While the accuracy of such systems is superior, the establishment and the maintenance thereof are very costly. The operating costs are further aggravated in that it is necessary to exactly determine those target areas at which the explosive charges are to be detonated, which is effected by measurements during the delivery process. For that purpose, operating personnel must be present at the cableway facility during the delivery of the explosives to the target area. The system is furthermore naturally limited to those areas which is covered by the cableway system.

It has also been known to manually throw explosive charges into avalanche slopes. Since, however, it is most important to ensure the safety of operating personnel, this method can only trigger avalanches to a very limited extent. Also, it is possible to throw explosive charges into avalanche slopes from helicopters. Besides the fact that this method is also costly, it requires weather conditions, in which helicopter flights are possible and admissible. This method, therefore, is subject to large organizational limitations.

SUMMARY OF THE INVENTION

It is accordingly an object of the invention to provide a device for triggering an avalanche, which overcomes the above-mentioned disadvantages of the heretofore-known devices and methods of this general type and which allows explosive charges to be conveyed into avalanche slopes at a relatively small expense on the one hand, yet with a relatively high accuracy on the other hand in order to artificially trigger an avalanche. It should thereby be possible to cover any number of target areas in a simple fashion. It should further be possible to trigger the avalanches at any given time and independently of climatic conditions, especially weather conditions, as well as independently of the accessibility of a given area due to weather conditions.

With the foregoing and other objects in view there is provided, in accordance with the invention, an apparatus for triggering an avalanche, comprising:

- an explosive charge to be propelled into an avalanche slope and detonated therein;
- a tube housing the explosive charge, the tube being closed at one end thereof; and
- a propelling charge disposed in the tube for propelling the explosive charge from the tube into the avalanche slope.

In other words, the above objects are satisfied in that the explosive charge is disposed in a tube which is closed at one end in which a propelling charge is placed, by means of which the explosive charge is propelled from the tube into the avalanche slope.

The propelling charge is preferably located between the bottom of the tube and the explosive charge. The insertion of the explosive charge and the propelling charges thereby takes place through the open end of the tube, i.e. by front-loading. In the alternative, the bottom of the tube may be removably attached to the same. In that case, the explosive charge and the propelling charge are inserted from the bottom end of the tube. Preferably a rigid plate made of stiff material is located between the explosive charge and the propelling charge by which the thrust created by the propelling charge is transferred onto the explosive charge.

The explosive charge is preferably located in a tube-like casing which is closed by caps, wherein the propelling charge is arranged on the cap which is attached to the bottom closure of the tube.

In accordance with a further feature of the invention, the tube has a lateral slit or the like formed therein close to its bottom, through which the propelling charge can be inserted into the tube. In addition, a support plate may thereby be provided which has a recess for receiving the propelling charge and which can be inserted into the tube through the slit. There is further provided an intermediate plate or the like which can be inserted into the tube between the propelling charge and the bottom of the tube.

According to a further preferred feature, there is provided a fuse which runs into an explosive capsule or cartridge in the explosive charge. This effects that the explosive charge is only detonated after it has reached the avalanche slope. The lighting mechanism for the fuse is further preferably connected with a bolt or the like which is arranged on the tube via a pulling element, wherein the length of the pulling elements is at least equal to the axial length of the tube. This guarantees that the explosive charge is only detonated as soon as it has left the tube, which safely prevents damage to or a destruction of the tube caused by a misfire of the propelling charge.

In accordance with an added feature of the invention, there is provided on the outside of the tube a terminal for an electric line leading to the propelling charge. The propelling charge which was inserted into the tube is connected to this terminal. The propelling charge may thereby be detonated via a control line or via a radio signal.

With the above and other features in view there is also provided, in accordance with the invention, a system for selectively triggering avalanches, comprising: a support carrying a multiplicity of tubes each being closed at one end and open at another end thereof; an explosive charge to be propelled into an avalanche slope and detonated therein disposed in at least one of the tubes; and a propelling charge disposed in the at least one tube for propelling the explosive charge from the tube into the avalanche slope. In a preferred embodiment, the support is swivellable about a substantially vertical axis.

In other words, there is provided a support device for a multiplicity of tubes for catapulting explosive charges which is either stationary or movable. The support device is pivotable about an approximately vertical axis. The tubes may thereby be adjusted and fixed with regard to their angular orientation on the support device. It is thus possible to aim the tubes at different target areas, whereby avalanches can be triggered in different areas by consecutive detonations of explosive charges.

In accordance with an added feature of the invention, the multiplicity of tubes are adjustably fastened in their angular position on the support.

In accordance with an additional feature of the invention, the system further comprises a housing disposed on the support, a set of the multiplicity of tubes being disposed within the housing.

In accordance with another feature of the invention, the housing includes an adjustable lid, preferably two electrically adjustable lids.

In accordance with a further feature of the invention, the system also comprises a multiplicity of mounting members, such as shells, each receiving one of the tubes, the mounting members being adjustably fastened to the support.

In accordance with again an added feature of the invention, there is provided a power source such as a battery and/or a solar panel.

In accordance with a concomitant feature of the invention the support may be a stationary support, or a mobile support mounted on a snow mobile, such as a sled or a motorized snow vehicle, or the like.

Other features which are considered as characteristic for the invention are set forth in the appended claims.

Although the invention is illustrated and described herein as embodied in an apparatus for triggering an avalanche or the like, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIG. 2 is a side elevational view of the apparatus mounted on a transport sledge;

FIG. 2*a* is a top plan view thereof;

DESCRIPTION OF THE PREFERRED EMBODIMENTS

Figure 1:
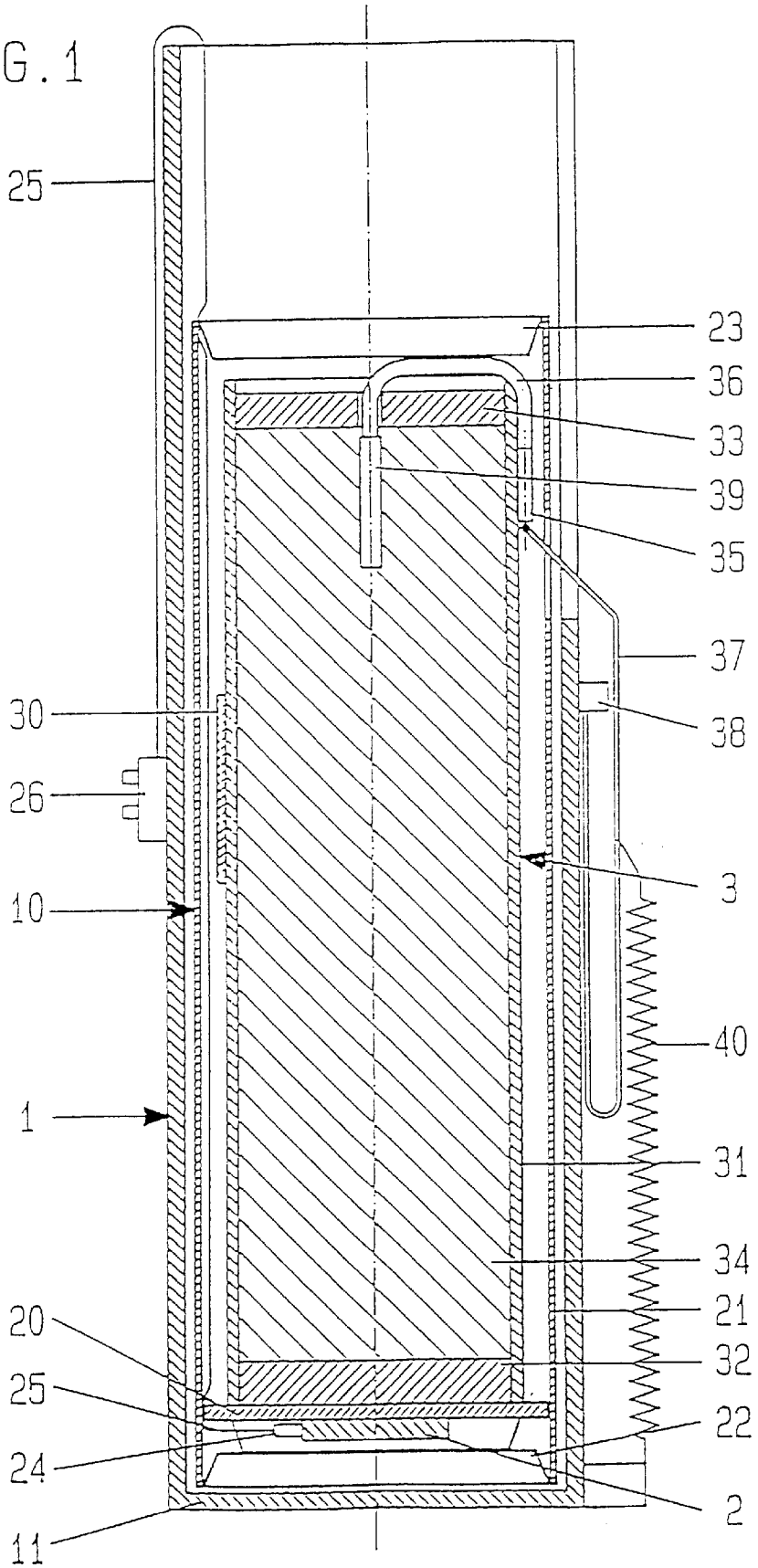
FIG. 1 is an axial-sectional view of an apparatus according to the invention.

Referring now to the figures of the drawing in detail and first, particularly, to FIG. 1 thereof, there is seen a tube 1 which is open on one end in which an explosive cartridge 10 is inserted. The explosive cartridge 10 is attached to a bottom 11 of the tube 1 and it contains a propelling charge 2 and an explosive charge 3. The explosive cartridge 10 has a tube-like casing 21 which is closed at its lower end via a cap 22 and on its upper end via a cap 23. The propelling charge 2 is located in the area of the lower cap 22. A plate 20 is attached thereto onto which the explosive charge 3 is attached. The propelling charge 2 further contains a detonator 24 which is connected to a clamp 26 via an electrical line 25.

The explosive charge 3 is also formed of a tube-like casing 31, which is closed at both front and back areas with caps 32 and 33 and which is filled with an explosive 34. An ignition or lighting mechanism 35 is located on the outside of the casing 31 from which a fuse 36 extends which penetrates the closing cap 33 and which ends in an explosive cartridge 39 which is arranged in the explosive 34. The ignition mechanism 35 includes a pulling element 37, such as a pull strap 37, which is attached at a bolt 38 or the like which extends out of the casing 1. The pulling element 37 is further attached to a retaining device in the form of a tension spring 40.

The tube 1 is made of metal, as for example sheet-metal or aluminum. In contrast, the plates 20 and the casing 31 of the explosive charge 3 are made of material which will rot due to weather influences, as for example cardboard, papier-mâché, a derived timber product, or a wood solid compound. The explosive 34 in the casing 31 is of the type which will not be triggered even through very low temperatures. On the outside of the casing 31 there is further arranged a reflector 30 which serves to more easily locate explosive charges 3 which have not effectively fired.

Figure 1A:
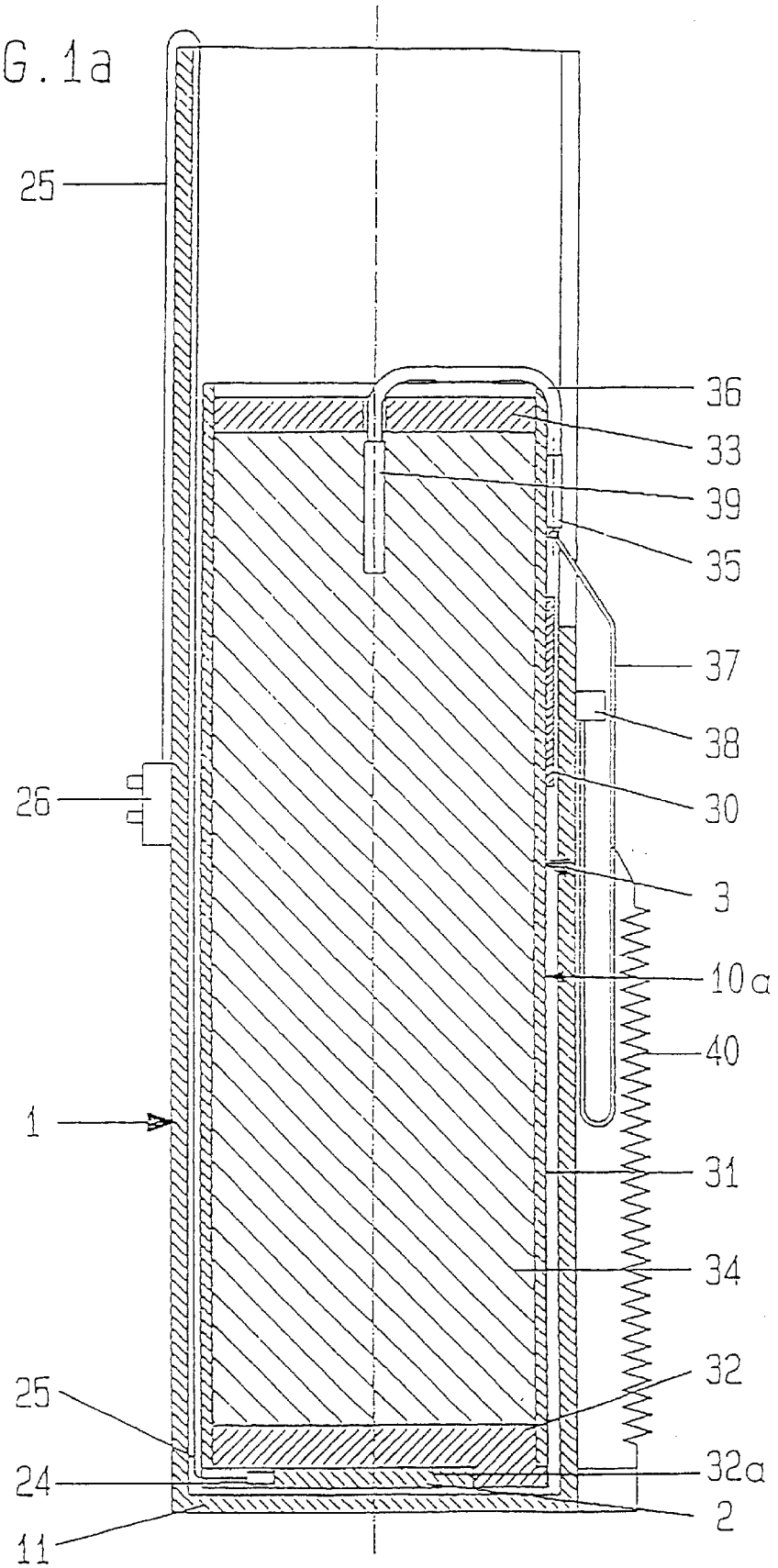
FIG. 1*a* is a similar view of an alternative embodiment as compared to FIG. 1.

In the embodiment shown in FIG. 1*a*, the explosive cartridge 10*a* consists of a casing 31. The cap 32 is formed with a lateral recess 32*a* and it is attached to the bottom 11 of the casing 31 in which the propelling charge 2 is inserted and held by an adhesive.

Figure 1B:
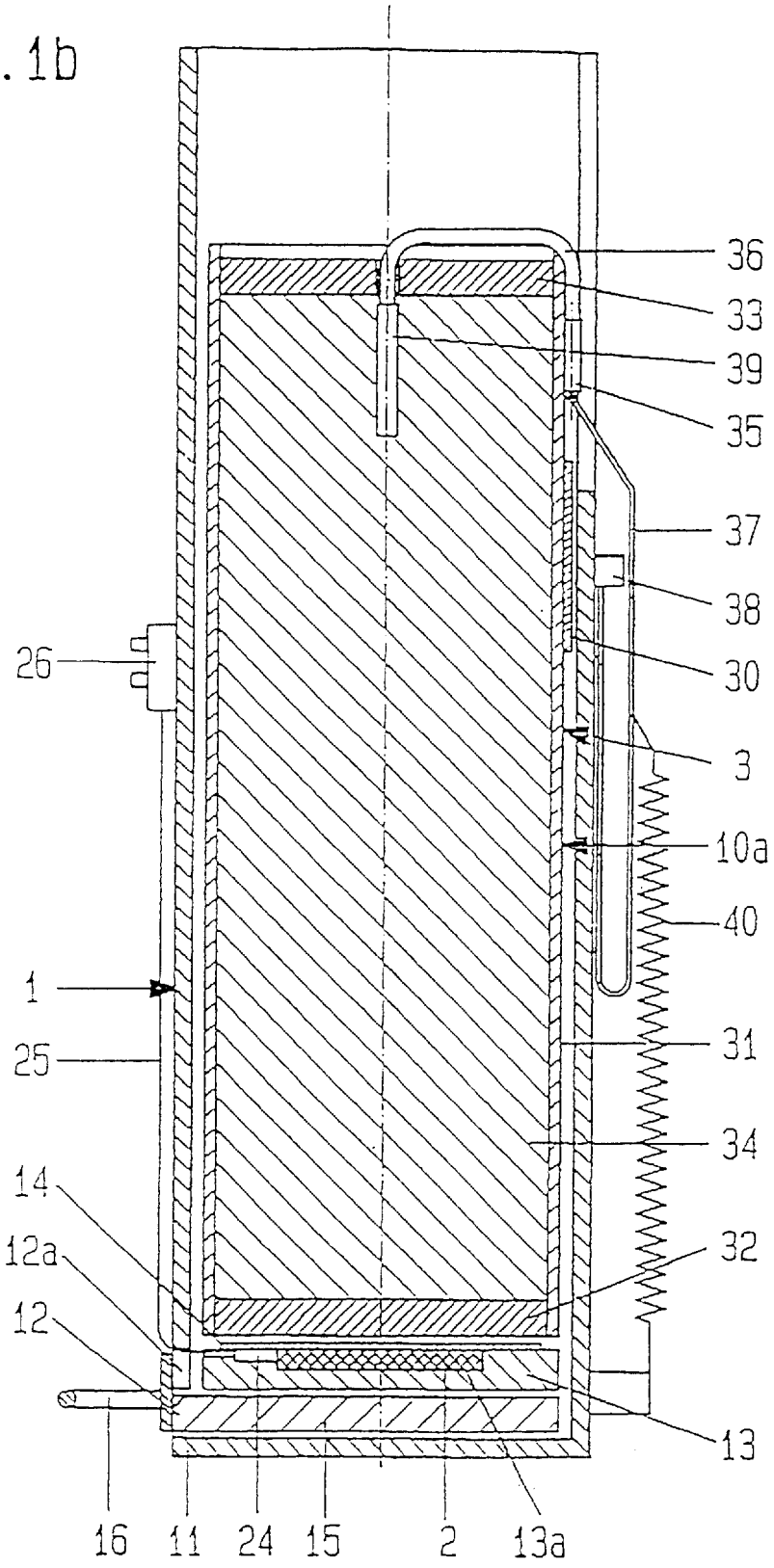
FIG. 1*b* is a similar view of a further alternative embodiment.

In the embodiment shown in FIG. 1*b*, the casing of the tube 1 is formed with a slit 12 close to the bottom 11 through which a support plate 13 can be laterally inserted into the tube 1 which forms a receiver for the propelling charge 2. The line 25 which leads to the terminal clamp 26 thereby projects through a further slit 12*a*. The plate 13 has a recess 13*a* on its side which faces the explosive charge 3, into which the powder material of the propelling charge 2 is filled. From the recess 13*a* a duct leads radially outwardly in which the line 25 is guided. The recess 13*a* is closed with a cover 14.

In order to avoid the leaking of gases through the slits 12 which form when the propelling charge 2 is detonated, there is further provided an intermediate plate 15 which is also inserted underneath the support plate 13 through the slit 12, wherein the support plate 13 is lifted relative to the slit 12 so that gases cannot leak trough it. The intermediate plate 15 is handled via a handle in the form of a ring 16 which extends therefrom through the slit 12. In order to more easily insert the intermediate plate 15 into the tube, a wedge-shaped slope can be provided on the side opposite to the handle 16.

In this embodiment the explosive cartridge 3 and the propelling charge 2 can be transported independently of each other wherein they are inserted into the tube 1 when the apparatus is prepared for triggering avalanches. Different amounts of propelling charges can be used with different sizes of the recess 13*a*, whereby different projectile distances can be reached. Alternatively, prefabricated propelling charges 2 of different sizes can be inserted into the recess 13*a* of the support plate 13.

Since the support plate 13 and the intermediate plate 15 are reusable, they can be manufactured from non-rotting material, such as, for example, from sheet metal.

The mode of operation of the apparatus is as follows:

The apparatus of the invention, or a set with a multiplicity of such apparatus, is installed at the foot of a slope or within a slope in which avalanches are to be triggered. When an electrical pulse is transmitted through the line 25 to the detonator 24 of the propelling charge 2, the propelling charge is detonated. This causes the explosive charge 3 to be propelled out of the tube 1 through the thrust created by the explosion. As soon as the explosive charge 3 has moved about a distance which is approximately equal the distance of the pulling element 37, the lighting mechanism 35 is activated by the pulling element 37, whereby the fuse 36 is lit. As long as the line 25 is brought along out of the tube 1, it is pulled out of the clamp 26. The propelling charge 2 causes the explosive charge 3 to be propelled over distances of, for example, 30 to 250 m into a slope in which an avalanche is to triggered. The explosive charge 3 is detonated as soon as the explosive cartridge 39 is lit via the fuse 36 whereby an avalanche is triggered because of the pressure wave created thereby.

The fact that the lighting mechanism 35 is triggered by the pulling element 37 prevents the explosive charge 3 from being detonated within the tube 1, which would destroy the same and which would also lead to the detonation of the explosive charges which are located next to it. The lighting mechanism 35 is triggered with the pulling element 37 only after the explosive charge 3 has exited the tube 1. Then a delay in detonation of for example 120 seconds is effected through the fuse 36 which guarantees that the explosive cartridge 39 is only ignited and that through this the explosive charge 3 is only brought to detonation after it has reached the target area.

In accordance with a further feature of the invention, there is also provided a mobile device, which will now be described in detail with reference to FIGS. 2 and 2*a*. This device comprises a sledge 4 on which there is disposed a support device 5 for a battery of apparatus 1 according to the invention. The apparatus 1 are located in a casing 6, which can be closed with lids 61 and 62. The lids 61 and 62 may thereby be moved with actuator motors. The apparatus 1 are inserted into sleeves 60 which are adjustably fastened opposite the support device 5. There is further located a mounting platform 7 below the casing 6 from which the casing 6 can be supplied with a multiplicity of apparatus 1.

The apparatus 1 are further closed off with caps 63, made for example of plastic foils, in order to prevent a penetration of moisture through which they could become inoperable.

A support post 52 is disposed on the sledge 4 which carries a solar panel 51. The outlet of the solar panel 51 is connected to a battery 54, which is also disposed on the support post 52. A control box is further arranged on the post 52 on which the outlet of a hand-held remote control device 55 is connected via a line 56. The control box 53 is also provided with an antenna 58.

Figure 3:
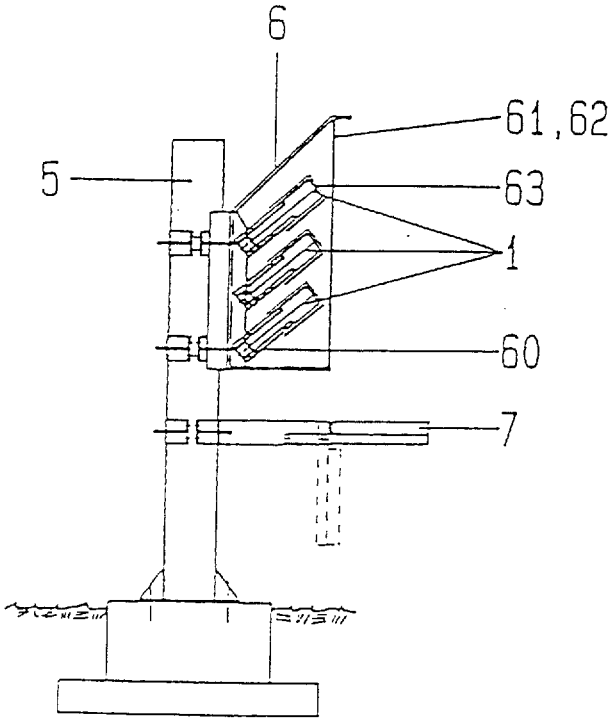
FIG. 3 is a side elevational view of a stationary embodiment, with the propelling system attached on a stationary support device.
Figure 3A:
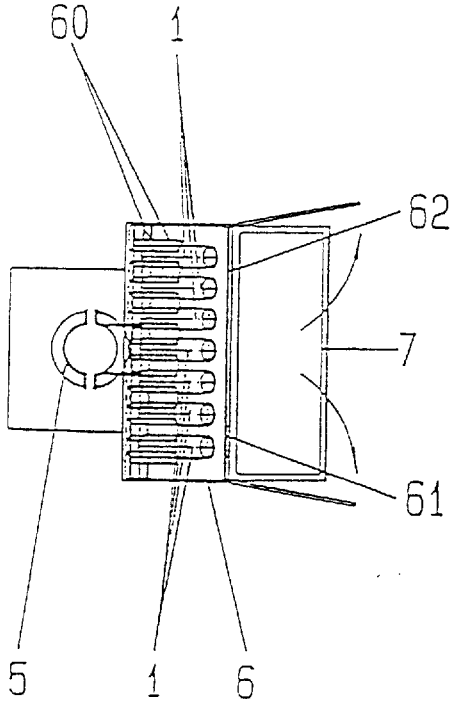
FIG. 3*a* is a top plan view thereof.

With reference to FIGS. 3 and 3*a*, the invention also provides for a stationary such system.

Figure 4:
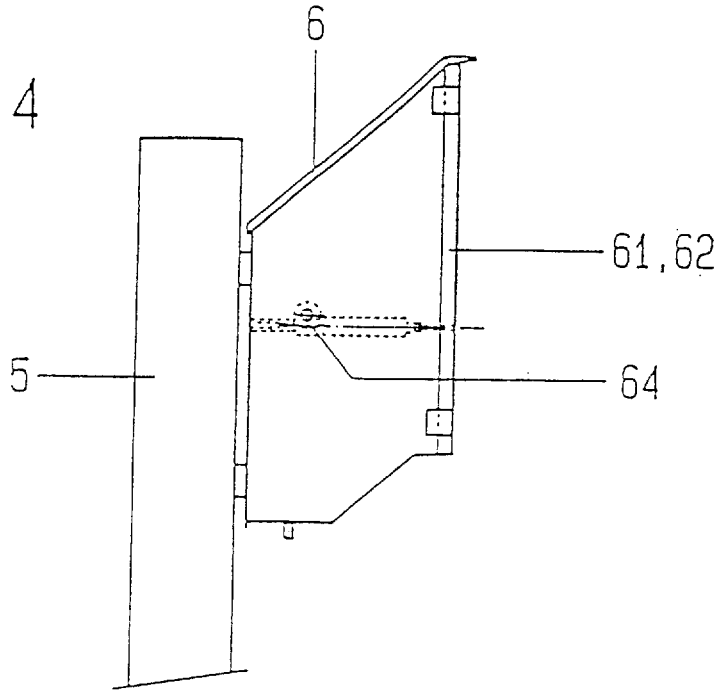
FIG. 4 is an enlarged partial side view of a detail of FIGS. 2 and 3.
Figure 4A:
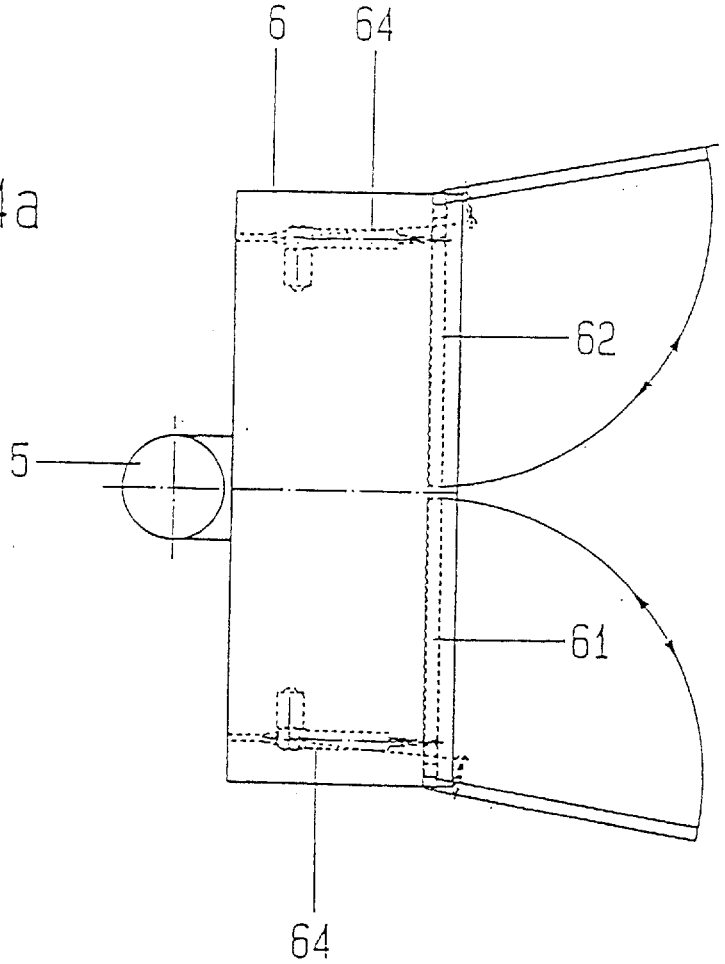
FIG. 4*a* is an enlarged partial top view of a detail of FIGS. 2*a* and 3*a*.

As seen in FIGS. 4 and 4*a*, two actuators 6 are located in the casing 6 through which the lids 61 and 62 are adjustable.

When the explosive charge 3 is to be propelled into an avalanche slope, at least one the lids 61 and 62 is moved to its open position and the propelling charge 2 is ignited. In order to reach different target areas, the carrier 5 can be rotated about a substantially vertical axis. Furthermore, the tubes 60 can be adjustably fastened in their angular position relative to the support 5. The swivelling of the support 5 and the adjustment of the angular position of the tubes 1 may be effected by motors, which may be operated via a control line or by radio. Furthermore, different throw distances can be achieved by differently dimensioned propelling charges 2.

Since the apparatus according to the invention are arranged in the casing 6 which is lockable by lids 61 and 62, they are protected against weather influences and against unauthorized access. The lids 61 and 62 can also be operated by remote control. The retaining device 40 prevents the pulling elements 37 from reaching the lids 61 and 62 after they have been separated from the lighting mechanism 35, whereby their function could be hindered. The power necessary for operating the device is provided by the battery 54 which is recharged by the solar panel 51. Alternatively, the system can be supplied with energy via electrical lines.

The apparatus according to the invention can, for example, also be mounted on snow mobiles, such as track rollers and the like. The propelling charges 2 may be triggered directly at the support column or via a control line. It is also possible for a receiver to be provided on the support device, through which the propelling charges may be triggered via radio control.

Such stationary or mobile devices can be equipped with 30 tubes 1, into which explosive cartridges 10 or 10*a* have been inserted.

The apparatus of the invention may be brought into the mountainous region at the onset of winter whereby they are available for use during the winter months. In the alternative, they may also be brought into the area during the winter. If necessary, additional explosive cartridges 10 or 10*a* may be supplied. Since the tubes 1 are kept in the shells 60, the explosive cartridges 10 or 10*a* can be inserted into the tubes 1 at any location and only the tubes 1 which contain the explosive cartridges 10 or 10*a* have to be inserted into the shells 60. The entire device is ready for operation as soon as the control lines 25 are connected to the terminal clamps 26.

I claim:

1. An apparatus for triggering an avalanche, comprising:

an explosive charge to be propelled into an avalanche slope and detonated therein, said explosive charge comprising an explosive, a detonator disposed in said explosive, and a lighting mechanism for triggering said detonator;

a tube housing said explosive charge, said tube having a given axial length and being closed at one end thereof;

a propelling charge disposed in said tube for propelling said explosive charge from said tube into the avalanche slope; and a pulling element having a length at least equal to the given axial length of said tube, said pulling element connecting said lighting mechanism of said explosive charge to said tube for triggering said lighting mechanism after said explosive charge has been propelled out of said tube.

2. The apparatus according to claim 1, wherein said propelling charge is disposed between said one end of said tube and said explosive charge.

3. The apparatus according to claim 1, wherein said one end of said tube is closed with a removably inserted bottom plate.

4. The apparatus according to claim 1, which further comprises an explosive cartridge disposed said tube, said explosive cartridge housing said propelling charge and said explosive charge.

5. The apparatus according to claim 4, wherein said explosive cartridge has a cylindrical casing in which said propelling charge and said explosive charge are contained.

6. The apparatus according to claim 1, which further comprises a rigid plate disposed between said propelling charge and said explosive charge.

7. The apparatus according to claim 1, which further comprises a cylindrical casing in which said explosive charge is disposed, said cylindrical casing being closed with a first cap on a forward end thereof and with a second cap at a bottom end thereof.

8. The apparatus according to claim 7, wherein said propelling charge is fastened on said second cap.

9. The apparatus according to claim 1, wherein said tube is formed with a lateral slit in vicinity of the one end, and the propelling charge is insertable into said tube through said lateral slit.

10. The apparatus according to claim 9, which further comprises a support plate which is insertable through said lateral slit, said support plate being formed with a recess for receiving said propelling charge.

11. The apparatus according to claim 9, which further comprises an intermediate plate disposed in said tube between said propelling charge and the bottom of said tube.

12. The apparatus according to claim 1, wherein said explosive charge further comprises a fuse connecting said detonator to said lighting mechanism.

13. The apparatus according to claim 1, including a bolt disposed on said tube, said lighting mechanism being connected to said bolt via said pulling element.

14. The apparatus according to claim 1, which further comprises a terminal disposed on an exterior of said tube, and an electrical line leading from said terminal to said propelling charge.

15. The apparatus according to claim 1, which further comprises a plastic foil covering said tube.

* * * * *

UNITED STATES PATENT AND TRADEMARK OFFICE
Certificate

Patent No. 5,872,326

Patented: February 16, 1999

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Michael Manhart, Lech am Arlberg, Austria; and Bernd Doppler, Lauterach, Austria.Signed and Sealed this Fifth Day of September 2006.

MICHAEL J. CARONE
*Supervisory Patent Examiner*
Art Unit 3641